US005081506A

United States Patent [19]

Borostyan

[11] Patent Number: 5,081,506

[45] Date of Patent: Jan. 14, 1992

[54] TRANSFER SYSTEM FOR A COLOR PRINTER

[75] Inventor: Stephen Borostyan, Victor, N.Y.

[73] Assignee: Xerox Corporation, Stamford, Conn.

[21] Appl. No.: 495,807

[22] Filed: Mar. 19, 1990

[51] Int. Cl.[5] ..... G03G 21/00

[52] U.S. Cl. ..... 355/308; 355/73; 355/312

[58] Field of Search ..... 355/73, 213, 271, 274, 355/312, 212, 221

[56] References Cited

U.S. PATENT DOCUMENTS

| | | | |
|---|---|---|---|
| 4,251,154 | 2/1981 | Russel | 355/326 |
| 4,294,540 | 1/1981 | Thettu | 355/312 X |
| 4,537,493 | 8/1985 | Russel | 355/312 |
| 4,712,906 | 12/1987 | Bothner et al. | 355/271 |
| 4,724,458 | 2/1988 | Roy et al. | 355/274 |
| 4,739,361 | 4/1988 | Roy et al. | 355/277 |
| 4,740,813 | 4/1988 | Roy | 355/274 |

FOREIGN PATENT DOCUMENTS

| | | | |
|---|---|---|---|
| 0033275 | 2/1983 | Japan | 355/271 |

*Primary Examiner*—A. T. Grimley
*Assistant Examiner*—P. J. Stanzione
*Attorney, Agent, or Firm*—H. Fleischer; J. E. Beck; R. Zibelli

[57] ABSTRACT

An apparatus in which successive toner images are transferred from a photoconductive drum to a sheet at a transfer zone. The sheet is transported by a perforated belt entrained about a stationary sleeve through a recirculating path. The sleeve has a plurality of spaced ports extending in and through the periphery thereof and connected to a vacuum source. In this way, the sheet is vacuum tacked to the belt to move in unison therewith in synchronism with the photoconductive drum. At the transfer zone, the sheet separates the belt and is interposed between the photoconductive member and a corona generator. The corona generator applies an electrostatic charge to the sheet to attract successive toner images thereto. The sheet moves with the belt in a recirculating path so that successive different color toner images are transferred thereto in registration with one another.

14 Claims, 2 Drawing Sheets

TRANSFER SYSTEM FOR A COLOR PRINTER

Figure 1:
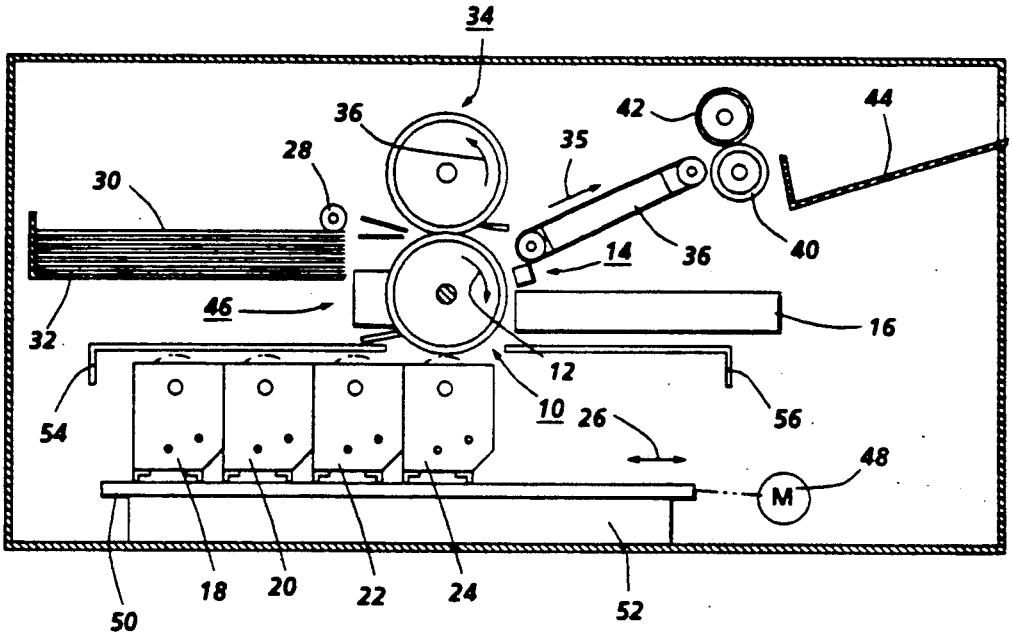

This invention relates generally to a color electrophotographic printing machine, and more particularly concerns a system for transferring successive toner images from a photoconductive member to a sheet.

In an electrophotographic printing machine, a photoconductive member is charged to a substantially uniform potential to sensitize the surface thereof. The charged portion of the photoconductive member is exposed. Exposure of the charged photoconductive member selectively dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a toner image on the photoconductive member which is subsequently transferred to a copy sheet. The toner image is heated to permanently affix it to the sheet in image configuration.

Multi-color electrophotographic printing is substantially identical to the foregoing process of black and white printing. However, rather than forming a single latent image on the photoconductive surface, successive latent images corresponding to the different colors desired in the copy are recorded. Each single color electrostatic latent image is developed with the appropriately colored toner. The single color toner images are transferred to the copy sheet in superimposed registration with one another. This creates a multi-layered toner image on the copy sheet. Thereafter, the multi-layered toner image is permanently affixed to the copy sheet creating a color copy. The developer material may be a liquid material or a powder material.

Generally, transfer systems used in multi-color printing machines move the copy sheet in a recirculating path so that successive toner images may be transferred thereto in superimposed registration with one another. One type of transfer system previously used has an electrically biased drum rotating in synchronism with the photoconductive drum. The copy sheet is secured to the drum by either gripper bars or vacuum tacking and rotates therewith. Another type of system uses gripper bars to secure the sheet to a belt moving in a recirculating path. The belt transports the sheet between a corona generator and the photoconductive drum at the transfer zone. Still another type of system uses a drum having a plastic mesh to push the sheet against the photoconductive drum. A corona generator applies an electrostatic charge to the sheet through the mesh. However, in time the plastic mesh gets dirty and builds up a charge which suppresses the transfer field. It is thus clear that various types of transfer systems have been devised for multi-color printing. The following disclosures appear to be relevant:

- U.S. Pat. No. 4,251,154 Patentee: Russel Issued: Feb. 17, 1981
- U.S. Pat. No. 4,537,493 Patentee: Russel Issued: Aug. 27, 1985
- U.S. Pat. No. 4,712,906 Patentee: Bothner et al. Issued: Dec. 15, 1987
- U.S. Pat. No. 4,724,458 Patentee: Roy et al. Issued: Feb. 9, 1988
- U.S. Pat. No. 4,739,361 Patentee: Roy et al. Issued: Apr. 19, 1988

- U.S. Pat. No. 4,740,813 Patentee: Roy Issued: Apr. 26, 1988

The relevant portions of the foregoing patents may be briefly summarized as follows:

U.S. Pat. No. 4,251,154, U.S. Pat. No. 4,537,493 and U.S. Pat. No. 4,712,906 disclose electrophotographic printing machines for producing colored copies on a sheet. The transfer systems have a transfer drum which secures sheets thereto by a vacuum. Different color images are transferred to the sheet while it is secured to the transfer drum.

U.S. Pat. No. 4,724,458, U.S. Pat. No. 4,739,361 and U.S. Pat. No. 4,740,813 all describe a transfer roll which may be used to form multi-color copies. The sheet is vacuum tacked to the transfer roll.

Pursuant to the features of the present invention, there is provided an apparatus for transferring successive toner images from a photoconductive member to a sheet at a transfer zone. The apparatus includes a flexible member. Means are provided for vacuum tacking at least a portion of the sheet to the flexible member with successive portions of the sheet being separated from the flexible member at the transfer zone. Means move the flexible member to transport the sheet in a recirculating path. Means apply an electrostatic charge to the sheet at the transfer zone to attract successive toner images thereto.

In another aspect of the present invention, there is provided a printing machine of the type in which successive toner images are transferred from a photoconductive member to a sheet at a transfer zone. The printing machine includes a flexible member. Means are provided for vacuum tacking at least a portion of the sheet to the flexible member with successive portions of the sheet being separated from the flexible member at the transfer zone. Means move the flexible member to transport the sheet in a recirculating path. Means apply an electrostatic charge to the sheet at the transfer zone to attract successive toner images thereto.

Figure 2:
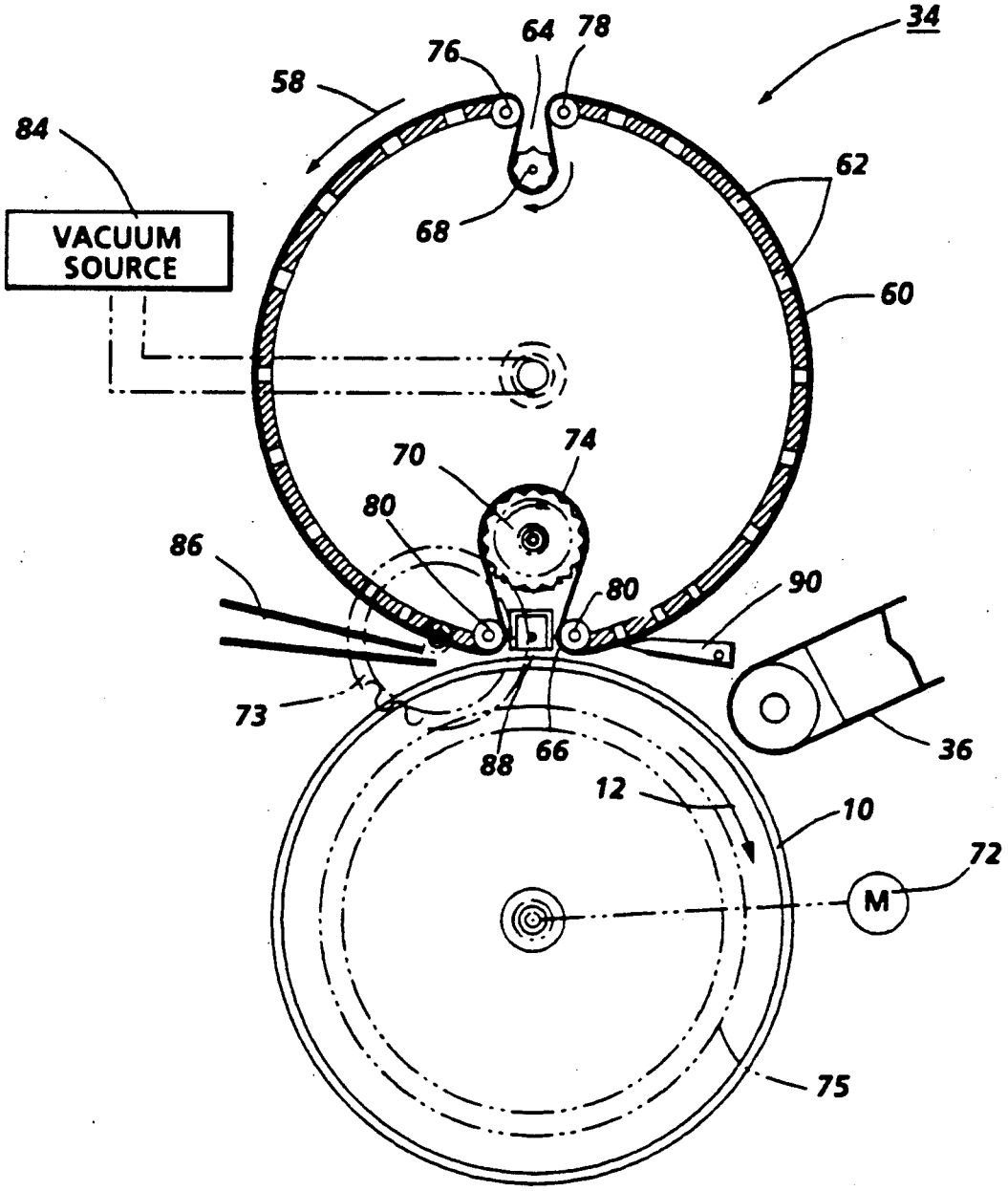

Other aspects of the present invention will become apparent as the following description proceeds and upon reference to the drawings, in which:

FIG. 1 is a schematic elevational view illustrating a color electrophotographic printing machine incorporating the features of the present invention therein; and FIG. 2 is a schematic elevational view showing the transfer apparatus of the FIG. 1 printing machine.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. FIG. 1 depicts a color electrophotographic printing machine incorporating the features of the present invention therein. It will become evident from the following discussion that the present invention is equally well suited for use in a wide variety of printing machines, and is not necessarily limited in its application to the particular machine shown herein.

Turning initially to FIG. 1, there is shown a color electrophotographic printing machine employing a photoconductive drum 10. Preferably, photoconductive drum 10 is made from a photoconductive material such as selenium. However, any suitable photoconductive material may be used. Drum 10 rotates in the direction of arrow 12 to advance successive portions of the photoconductive surface sequentially through the various processing stations disposed about the path of movement thereof.

Initially, a portion of photoconductive drum 10 passes through the charging station. At the charging station, a corona generating devices, indicated generally by the reference numeral 14 charges photoconductive drum 10 to a relatively high, substantially uniform potential.

Next, the charged photoconductive surface is rotated to the exposure station. The exposure station includes an electronic subsystem that transmits a set of signals corresponding to a series of raster scan lines of different colors for the copy. These signals are transmitted to a raster output scanner (ROS) 16. ROS 16 includes a laser with rotating polygon mirror blocks. Preferably, a nine facet polygon is used. The ROS illuminates the charged portion of photoconductive drum 10 at a rate of about 400 pixels per inch. The ROS will expose the photoconductive drum to record three latent images. One latent image is adapted to be developed with cyan developer material. Another latent image is adapted to be developed with magenta developer material with the third latent image being developed with yellow developer material. The latent images formed by the ROS on the photoconductive drum correspond to the signals from the electronic subsystem.

After the electrostatic latent image has been recorded on photoconductive drum 10, drum 10 advances the electrostatic latent image to the development station. The development station includes four individual developer units generally indicated by the reference numerals 18,20,22 and 24. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 18, 20 and 22, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive drum corresponding to the green regions will record the red and blue portions as areas of relatively high charge density on photoconductive drum 10, while the green areas will be reduced to a voltage level ineffective for development. The charged areas are then made visible by having developer unit 18 apply green absorbing (magenta) toner particles onto the electrostatic latent image recorded on photoconductive drum 10. Similarly, a blue region is developed by developer unit 20 with blue absorbing (yellow) toner particles, while the red region is developed by developer unit 22 with red absorbing (cyan) toner particles. Developer unit 24 contains black toner particles and may be used to develop the electrostatic latent image formed from a black and white original document. Each of the developer units is moved into and out of the operative position. In the operative position, the developer unit is in the development zone with the magnetic brush being closely adjacent the photoconductive drum, while, in the non-operative position, the magnetic brush is spaced therefrom. During development of each electrostatic latent image only one developer unit is in the operative position, the remaining developer units are in the non-operative position. This insures that each electrostatic latent image is developed with toner particles of the appropriate color without comingling. In FIG. 1, developer unit 24 is shown in the operative position with developer units 18, 20 and 22 being in the non-operative position. The developer units in the non-operative position are sealed to prevent the escape of toner therefrom and to prevent contamination of the developer material in each developer unit. A shield or cover 54, located on one side of the development zone, seals the non-operative developer units located on that side of the development zone. A similar shield or cover 56, located on the other side of the development zone, seals the non-operative developer units located on that side of the development zone. A motor 48 coupled to developer carriage 50 translates the developer units in a horizontal direction, as indicated by arrow 26, between the non-operative positions and the operative position. A housing 52 having a chamber therein, is mounted beneath developer carriage 50 for storing waste toner.

After development, the toner image is moved to the transfer station where the toner image is transferred to a sheet of support material, such as plain paper amongst others. At the transfer station, the sheet feeder, indicated generally by the reference numeral 28, separates the uppermost sheet from a stack of sheets 30 supported on tray 32. The sheet is advanced to the transfer system, indicated generally by the reference numeral 34, and vacuum tacked to a perforated, flexible belt wrapped about a drum. The flexible belt moves about the drum in the direction of arrow 58. At the transfer zone, portions of the sheet are released from the belt and pass between a corona generator and the photoconductive drum. The corona generator applies an electrostatic charge to the sheet to attract the toner image from the photoconductive drum to the sheet. As the sheet moves in a recirculating path with the belt, each of the differently colored toner images are transferred, in superimposed registration with one another, to the sheet to form the multicolor copy. The transfer system will be described hereinafter in further detail with reference to FIG. 2.

After the last transfer operation, the sheet is released from the belt and advanced by a conveyor 36, in the direction of arrow 38, to the fusing station. At the fusing station the sheet passes through the nip defined by a heated fuser roll 40 and a pressure roll 42. The toner image contacts fuser roll 40 so as to be affixed to the sheet. Thereafter, the sheet is advanced to catch tray 44 for subsequent removal therefrom by the machine operator.

A blade cleaner, indicated generally by the reference numeral 46, is periodically moved into and out of contact with drum 10. The blade cleaner is moved into contact with the photoconductive drum when there is no toner image thereon so as to remove residual toner particles remaining after the transfer operation. Any residual charge remaining on the photoconductive drum is also removed therefrom prior to the start of the next successive cycle by illuminating drum 10.

Referring now to FIG. 2, there is shown further details of the transfer system. As depicted thereat, transfer system 34 has a tubular sleeve 60 with a plurality of spaced ports 62 in and extending through the peripheral surface thereof. The sleeve is mounted stationarily on the printing machine frame. Sleeve 60 has slots 64 and 66 therein. An idler sprocket gear 68 is mounted internally of sleeve 60 in the region of slot 64. A sprocket gear 68 is mounted resiliently, e.g. on leaf springs, to resiliently hold belt 74 against sleeve 60. A drive sprocket gear 70 is mounted internally of sleeve 60 in the region of slot 66. Motor 72 drives sprocket gear 70. A flexible transport belt 74 having a plurality of perforations, i.e. holes, therein is wrapped about sleeve 60. Belt 74 has a sprocket hole pattern along a side marginal region which meshes with sprocket gears 68 and 70. Belt 74 passes through slots 64 and 66 and the sprocket holes in the side marginal region therein meshes with idler sprocket gear 68 and drive sprocket gear 70. Idler rollers 76 and 78 are located on opposed sides of slot 64 to support belt 74 as it passes around sprocket gear 68. Similarly, idler rollers 80 and 82 are located on opposed sides of slot 66 to support belt 74 as it passes around sprocket gear 70. A vacuum source 84, e.g. a blower, is coupled by conduits to ports 62 and, in turn, to the perforations in belt 74 wrapped thereabout to vacuum tack the sheet to belt 74. A corona generator 88 is located in slot 66, opposed from photoconductive drum 10, defining the transfer zone. Baffle 86 guides the lead edge of the sheet to a location where it is acquired by belt 74. Motor 72 drives drum 10. Gear 75 is mounted on the shaft of drum 10 and rotates in unison therewith. Gear 75 drives gear 73, which, in turn, drives gear 70. Gear 70 moves belt 74 around the peripheral surface of sleeve 60 in the direction of arrow 58. In this way, belt 74 is driven in synchronism with drum 10, i.e. belt 74 and drum 10 have the same tangential velocity at the transfer zone. The sheet, vacuum tacked to belt 74, moves in unison with belt 74 in a recirculating path. Thus, the sheet moves in synchronism with drum 10, i.e. at the same tangential velocity in the transfer zone. In this way, the sheet and the toner image enter the transfer zone in registration with one another. As the sheet enters the transfer zone, the lead edge thereof separates from belt 74 and is interposed between corona generator 88 and photoconductive drum 10. It is clear that the transport system for the sheet does not require lead edge gripper bars. Corona generator 88 sprays ions onto the back side of the sheet to apply an electrostatic charge to the sheet for attracting toner images thereto. As the sheet passes through the transfer zone, the lead edge is re-acquired by belt 74 and vacuum tacked thereto. This process is repeated for each cycle until all of the different color toner images have been transferred to the sheet in superimposed registration with one another. After the last toner image is transferred to the sheet, stripper finger 90 separates the sheet from belt 74 and guides it onto conveyor 36. Conveyor 36 is a vacuum transport and the sheet is vacuum tacked thereto. The sheet with the toner images thereon is advanced by vacuum transport 36 to the fusing station.

In recapitulation, the apparatus of the present invention transfers successive toner images from a photoconductive member to a sheet. The sheet is vacuum tacked to a belt entrained about a stationary tubular sleeve. In this way the belt transports the sheet in a recirculating path through a transfer zone. At the transfer zone, a corona generator applies an electrostatic charge to the sheet to attract the toner image from the photoconductive drum thereto. Successive different color toner images are transferred to the sheet in superimposed registration with one another to form a color copy.

It is, therefore, evident that there has been provided in accordance with the present invention, an apparatus for transferring successive different color toner images from a photoconductive drum to a sheet that fully satisfies the aims and advantages hereibefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for transferring successive toner images from a photoconductive member to a sheet at a transfer zone, including:

a flexible member;

means for vacuum tacking at least a portion of the sheet to said flexible member with successive portions of the sheet being separated from said flexible member at the transfer zone;

means for moving said flexible member to transport the sheet in a recirculating path; and a corona generator adapted to spray ions onto the backside of the sheet in the transfer zone for applying an electrostatic charge to the sheet at the transfer zone to attract successive toner images thereto.

2. An apparatus having a moving photoconductive member according to claim 1, wherein said moving means moves said flexible member in sychronism with the photoconductive member to transfer the toner images to the sheet in registration with one another.

3. An apparatus according to claim 2, wherein the sheet is interposed between said applying means and the photoconductive member at the transfer zone.

4. An apparatus for transferring successive toner images from a photoconductive member to a sheet at a transfer zone, including:

a flexible member;

means for vacuum tacking at least a portion of the sheet to said flexible member with successive portions of the sheet being separated from said flexible member at the transfer zone, said vacuum tacking means comprises a tubular sleeve having a plurality of ports in and extending through the peripheral surface thereof, and a vacuum source connected to the apertures in the tubular sleeve;

means for moving said flexible member to transport the sheet in a recirculating path, said moving means moves said flexible member in synchronism with the photoconductive member to transfer the toner images to the sheet in registration with one another; and a corona generator to spray ions onto the backside of the sheet in the transfer zone for applying an electrostatic charge to the sheet at the transfer zone to attract successive toner images thereto with the sheet being interposed between said applying means and the photoconductive member at the transfer zone.

5. An apparatus for transferring successive toner images from a photoconductive member to a sheet at a transfer zone, including:

a flexible member;

means for vacuum tacking at least a portion of the sheet to said flexible member with successive portions of the sheet being separated from said flexible member at the transfer zone, said vacuum tacking means comprises a tubular sleeve having a plurality of ports in and extending through the peripheral surface thereof, and a vacuum source connected to the apertures in the tubular sleeve said flexible member includes a perforated belt entrained about said tubular sleeve;

means for moving said flexible member to transport the sheet in a recirculating path, said moving means moves said flexible member in synchronism with the photoconductive member to transfer the toner images to the sheet in registration with one another; and means for applying an electrostatic charge to the sheet at the transfer zone to attract successive toner images thereto with the sheet being interposed between said applying means and the photoconductive member at the transfer zone.

6. An apparatus according to claim 5, wherein said applying means includes a corona generator adapted to spray ions onto the backside of the sheet in the transfer zone.

7. An apparatus according to claim 6, wherein said tubular sleeve is stationary.

8. A printing machine of the type in which successive toner images are transferred from a moving photoconductive member to a sheet at a transfer zone, including:

a flexible member;

vacuum means for releasably securing at least a portion of the sheet to said flexible member with successive portions of the sheet being separated from said flexible member at the transfer zone, thereby securing the sheet to said flexible member without using lead edge gripper bars;

drive means for moving said flexible member to transport the sheet in a recirculating path in synchronism with the moving photoconductive member; and a corona generator adapted to spray ions onto the backside of the sheet in the transfer zone for applying an electrostatic charge to the sheet at the transfer zone to attract successive toner images thereto in registration with one another.

9. A printing machine according to claim 8, wherein the sheet is interposed between said applying means and the photoconductive member at the transfer zone.

10. A printing machine according to claim 9, wherein said vacuum tacking means includes:

a tubular sleeve having a plurality of ports in and extending through the peripheral surface thereof; and a vacuum source connected to the apertures in the tubular sleeve.

11. A printing machine of the type in which successive toner images are transferred from a moving photoconductive member to a sheet at a transfer zone, including:

a flexible member;

vacuum means for releasably securing at least a portion of the sheet to said flexible member with successive portions of the sheet being separated from said flexible member at the transfer zone, thereby securing the sheet to said flexible member without using lead edge gripper bars, said vacuum securing means includes a tubular sleeve having a plurality of ports in and extending through the peripheral surface thereof, and a vacuum source connected to the apertures in the tubular sleeve said flexible member includes a perforated belt entrained about said tubular sleeve;

drive means for moving said flexible member to transport the sheet in a recirculating path in synchronism with the moving photoconductive member; and means for applying an electrostatic charge to the sheet at the transfer zone to attract successive toner images thereto in registration with one another with the sheet being interposed between said applying means and the photoconductive member at the transfer zone.

12. A printing machine according to claim 11, wherein said applying means includes a corona generator adapted to spray ions onto the backside of the sheet in the transfer zone.

13. A printing machine according to claim 12, wherein said moving means moves aid flexible belt in synchronism with the movement of the photoconductive member.

14. A printing machine according to claim 13, wherein said tubular sleeve is stationary.

* * * * *